US011505368B2

(12) United States Patent
Woo et al.

(10) Patent No.: US 11,505,368 B2
(45) Date of Patent: Nov. 22, 2022

(54) FLEXIBLE CONTAINER

(71) Applicant: Progressive International Corporation, Kent, WA (US)

(72) Inventors: Geoff Woo, Seattle, WA (US); Joseph Kent, Seattle, WA (US)

(73) Assignee: Progressive International Corporation, Kent, WA (US)

( * ) Notice: Subject to any disclaimer, the term of this patent is extended or adjusted under 35 U.S.C. 154(b) by 0 days.

(21) Appl. No.: 17/146,273

(22) Filed: Jan. 11, 2021

(65) Prior Publication Data

US 2021/0214129 A1 Jul. 15, 2021

Related U.S. Application Data

(60) Provisional application No. 63/016,530, filed on Apr. 28, 2020, provisional application No. 62/967,894, filed on Jan. 30, 2020, provisional application No. 62/959,797, filed on Jan. 10, 2020.

(51) Int. Cl.
*B65D 33/25* (2006.01)
*B65D 33/01* (2006.01)

(52) U.S. Cl.
CPC ..... *B65D 33/2541* (2013.01); *B65D 33/01* (2013.01)

(58) Field of Classification Search
CPC ..... B65D 33/2541; B65D 33/01
USPC ..... 383/61.1
See application file for complete search history.

(56) References Cited

U.S. PATENT DOCUMENTS 2,107,216 A * 2/1938 Rogers ..... A44B 19/32 383/33
2,519,290 A * 8/1950 Saltz ..... A24F 23/02 493/214
2,674,289 A * 4/1954 Silverman ..... A24F 23/02 383/61.2
2,962,070 A * 11/1960 Towles ..... A24F 23/02 383/59
4,006,764 A * 2/1977 Yamamoto ..... B65D 85/00 206/320
4,941,238 A * 7/1990 Clark ..... A44B 19/14 24/389
5,743,405 A * 4/1998 Reid ..... A45C 11/20 206/541
6,185,796 B1 * 2/2001 Ausnit ..... B65D 33/2541 24/585.1
9,371,153 B1 * 6/2016 Nouri ..... B65D 75/22
11,097,505 B2 * 8/2021 Denis ..... B31B 70/26
(Continued)

FOREIGN PATENT DOCUMENTS

JP 2004026193 A * 1/2004
WO WO-2009090674 A2 * 7/2009 ..... B65D 33/2591

*Primary Examiner* — Jes F Pascua
(74) *Attorney, Agent, or Firm* — Lowe Graham Jones PLLC

(57) ABSTRACT

A flexible container includes a first panel formed from a flexible elastomeric material and a second panel formed from the flexible elastomeric material which is preferably a food grade silicone. The panels join together to form the flexible container and define an interior volume. A first closure and a second closure are provided along an opening defined at a portion of a perimeter of the flexible container, in which the first closure includes mating interlocking teeth and the second closure includes a mating rail and groove.

15 Claims, 16 Drawing Sheets

(56) References Cited

U.S. PATENT DOCUMENTS

| | | | | |
|---|---|---|---|---|
| 2003/0223654 | A1* | 12/2003 | Gerrits | B65D 33/2541 383/63 |
| 2008/0240625 | A1* | 10/2008 | McCracken | B65D 33/2566 383/64 |
| 2011/0069911 | A1* | 3/2011 | Ackerman | B65D 31/10 383/64 |
| 2017/0156537 | A1* | 6/2017 | Godfroid | B65D 33/008 |
| 2018/0251267 | A1* | 9/2018 | Finell | A47G 19/02 |
| 2020/0239194 | A1* | 7/2020 | Yosufy | B65D 33/1683 |

* cited by examiner

FLEXIBLE CONTAINER

FIELD OF THE INVENTION

This invention relates to resealable bags or containers for storing food items.

BACKGROUND OF THE INVENTION

It can be convenient to use a resealable bag or other form of container for storing food items. A flexible plastic bag, for example, is commonly used for storing a wide array of foods. In many cases, a closure provided at the top of the bag is intended to seal the bag against moisture, or to make the bag airtight. Many different closures have been attempted, but they generally fail in their effort to both produce an airtight and watertight seal while also remaining sealed in the presence of food within the bag which may provide an outward force, acting against the seal and sometimes causing the bag to become unsealed or to open entirely.

In addition to use for storage, bags made from a thicker silicone material are popular for use with sous vide cooking. In such cases, an airtight and watertight seal can be especially important, to protect the food from the sous vide water bath.

In an effort to maintain the sealing force, some have taught the use of a clip on either side of a bag. For example, U.S. patent publication 2006/0034551 illustrates the use of two-piece clip to be positioned on each side of a bag to capture the bag within the clip in an effort to seal it. Others teach the use of a closure of a variety of types, generally directing the focus to the shape of the rail and groove used for the bag closure. Examples are shown in U.S. patent publication 2019/0202604, and in 2014/0270579. In yet other cases, bags have incorporated a closure having combined mechanical and adhesive qualities rather than relying solely on a frictional or mechanical attachment. An example of this type is shown in U.S. Pat. No. 8,875,356. Each of these suffers from one or more drawbacks in their inability to maintain a seal, or to keep the bag closed, or in yet other defects or complexities.

SUMMARY OF THE INVENTION

A flexible container in accordance with preferred versions of the invention is defined by a first panel formed from a flexible elastomeric material and having a first panel top, a first panel bottom, and a pair of opposing first panel sides extending between the first panel top and the first panel bottom. A second panel is also formed from the flexible elastomeric material and has a second panel top, a second panel bottom, and a pair of opposing second panel sides extending between the second panel top and the second panel bottom.

The second panel is joined to the first panel to form the flexible container and defines an interior volume between the first panel and the second panel, the flexible container having a flexible container top, a flexible container bottom, and a pair of opposing flexible container sides extending between the flexible container top and the flexible container bottom.

In the preferred implementation, a first closure is positioned adjacent the flexible container top, the first closure having a first plurality of teeth extending along the first panel top and a second plurality of teeth extending along the second panel top, the first plurality of teeth being removably interlockable with the second plurality of teeth. A second closure is also positioned adjacent the flexible container top and adjacent the first closure, the second closure having a rail extending along the first panel top and a groove extending along the second panel top, the rail being sized and configured to removably seat within the groove to provide a fluid-tight seal along the second closure. Accordingly, the flexible container top may be selectively closed by interlocking the first plurality of teeth with the second plurality of teeth and seating the rail within the groove.

In some versions, the second closure is positioned between the first closure and the flexible container top. Most preferably, the second closure extends fully between the pair of opposing flexible container sides.

In some versions, each of the first plurality of teeth and each of the second plurality of teeth is configured with a rounded head and a narrow neck. Most preferably, each of the first plurality of teeth extends in a direction from the first panel toward the second panel.

In preferred versions, the flexible elastomeric material comprises a food grade silicone material.

In some versions, a flap is positioned at the flexible container top, the first closure and the second closure being positioned between the flap and the flexible container bottom.

In some versions, the first closure and the second closure each extend from the flexible container top toward the flexible container bottom along at least one of the opposing flexible container sides, so that the first and second closures extend along the top and at least one of the sides of the container. It may further extend along the opposing side as well. The first closure and the second closure each may extend from the flexible container top fully to the flexible container bottom along the opposing flexible container sides, or only partially toward the bottom.

Some versions include a vent formed in the first panel, the vent being positioned between the first and the second closures and the flexible container bottom.

In some versions, the flexible container is configured with a first panel formed from a flexible elastomeric material and a second panel formed from the flexible elastomeric material, the second panel being joined to the first panel to form the flexible container and defining an interior volume between the first panel and the second panel. The flexible container has a perimeter and an opening provided along a portion of the perimeter, with a first closure positioned adjacent the opening at the portion of the perimeter, the first closure having a first plurality of teeth positioned on the first panel and a second plurality of teeth positioned on the second panel, the first plurality of teeth being removably interlockable with the second plurality of teeth. A second closure is also positioned adjacent the opening at the portion of the perimeter, the second closure having a rail positioned on the first panel and a groove positioned on the second panel, the rail being sized and configured to removably seat within the groove to provide a fluid-tight seal along the second closure. In this fashion, the flexible container may be selectively sealed by interlocking the first plurality of teeth with the second plurality of teeth and seating the rail within the groove.

In preferred versions, the second closure is positioned between the first closure and the interior volume. Most preferably, the portion of the perimeter extends along one half of the perimeter of the flexible container.

In some versions, a vent is formed in the first panel, the vent being positioned between the first and the second closures and the flexible container bottom and configured to allow a gas to escape from the interior volume when the flexible container is sealed at the first closure and the second closure. The vent may also include a plurality of vents. Most preferably, the vent is located on an interior surface of the flexible container, between the closures and the perimeter defining the sides and top of the container.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
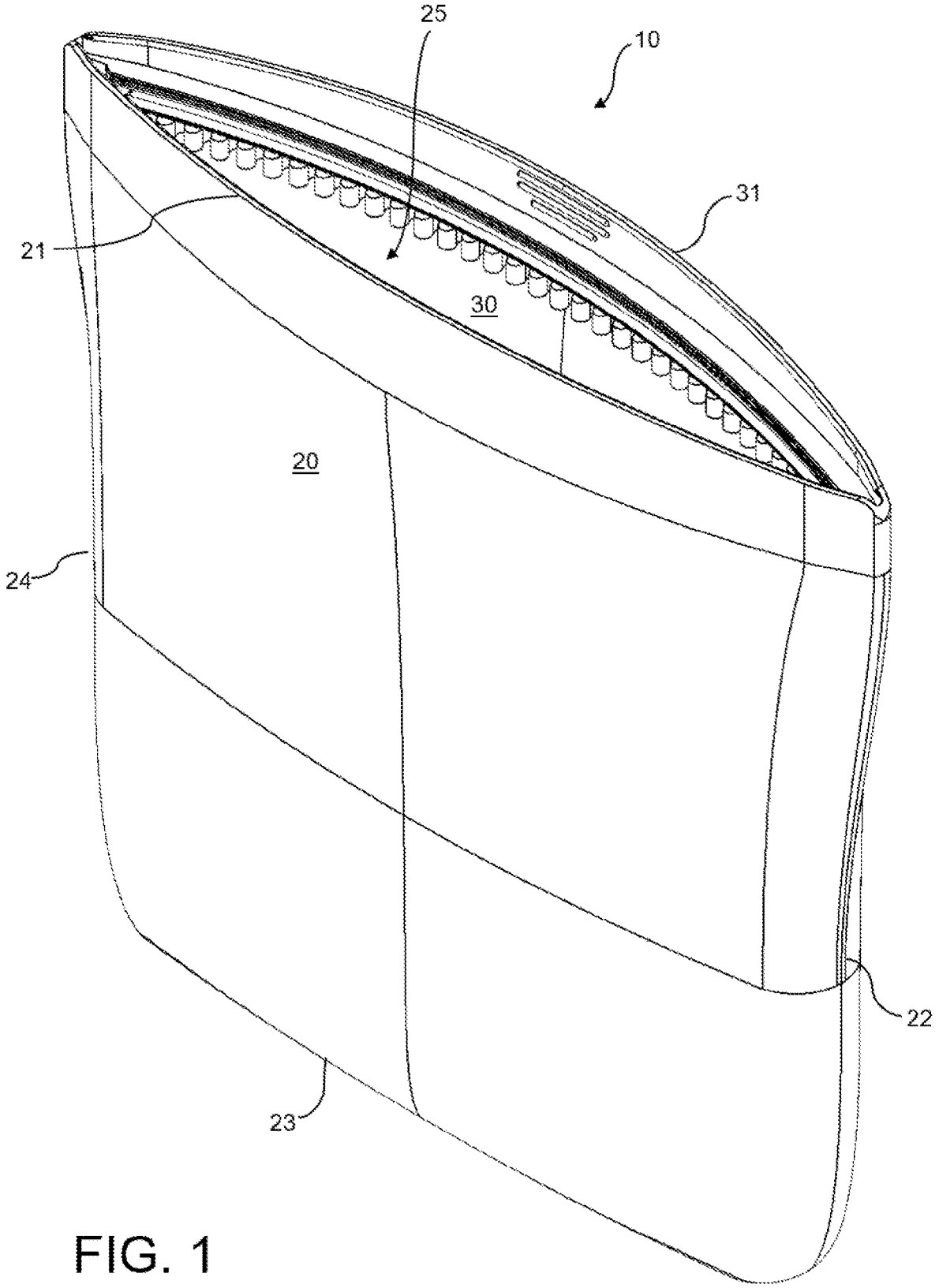
FIG. 1 is a front isometric view of a preferred flexible container.

A preferred version of a flexible container 10 is shown in an isometric view in FIG. 1. In the illustrated example, the container 10 is made from food grade silicone and is thicker than a standard plastic sandwich bag. In general, the bag is preferably flexible, and it may be constructed from other materials or combinations of materials such as food grade thermoplastic elastomers.

Figure 7:
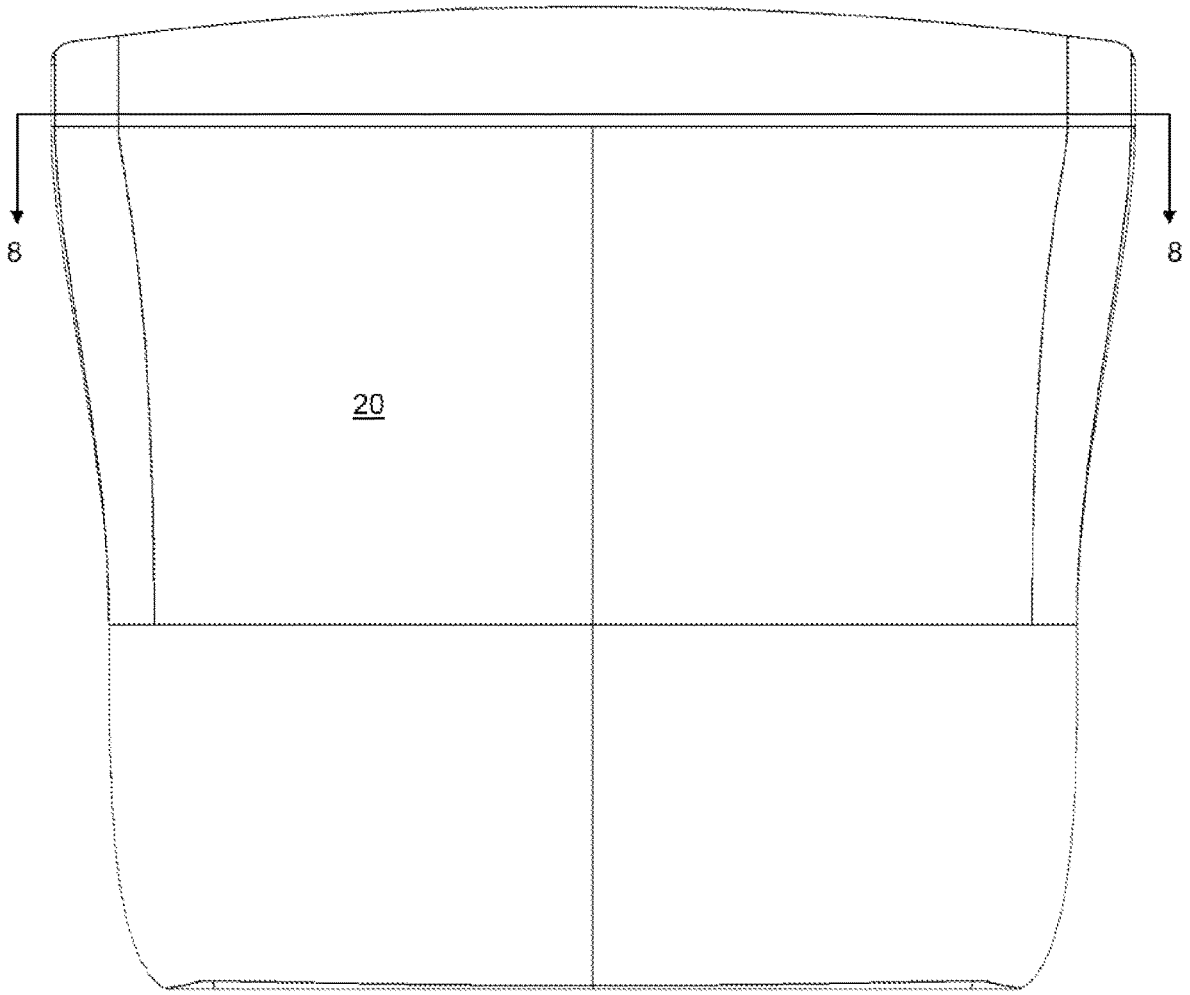
FIG. 7 is an elevational view of a preferred flexible container.

In the illustrated example, the container is configured as a bag 10 having a first panel 20 and a second panel 30. The opposing first and second panels are joined along a first side 22, a bottom 23, and a second side 24. Each panel includes a top end 21, 31 which combine to form a top end of the container, and further providing access to the interior space or volume 25 defined in the space between the first and second panels. In FIG. 1, the top ends 21, 31 are shown spaced apart from one another, thereby defining an opening for access to the interior space. The preferred flexible container is illustrated as generally having a rectangular shape when viewed from an elevational view, such as seen in FIG. 7, such that the top, bottom, and opposing sides define a generally rectangular perimeter. Though it may be generally rectangular, the sides may not be perfectly straight, and the corners are preferably rounded. Moreover, the flexible container may define a perimeter defining a shape that is not generally rectangular in other versions.

Figure 2:
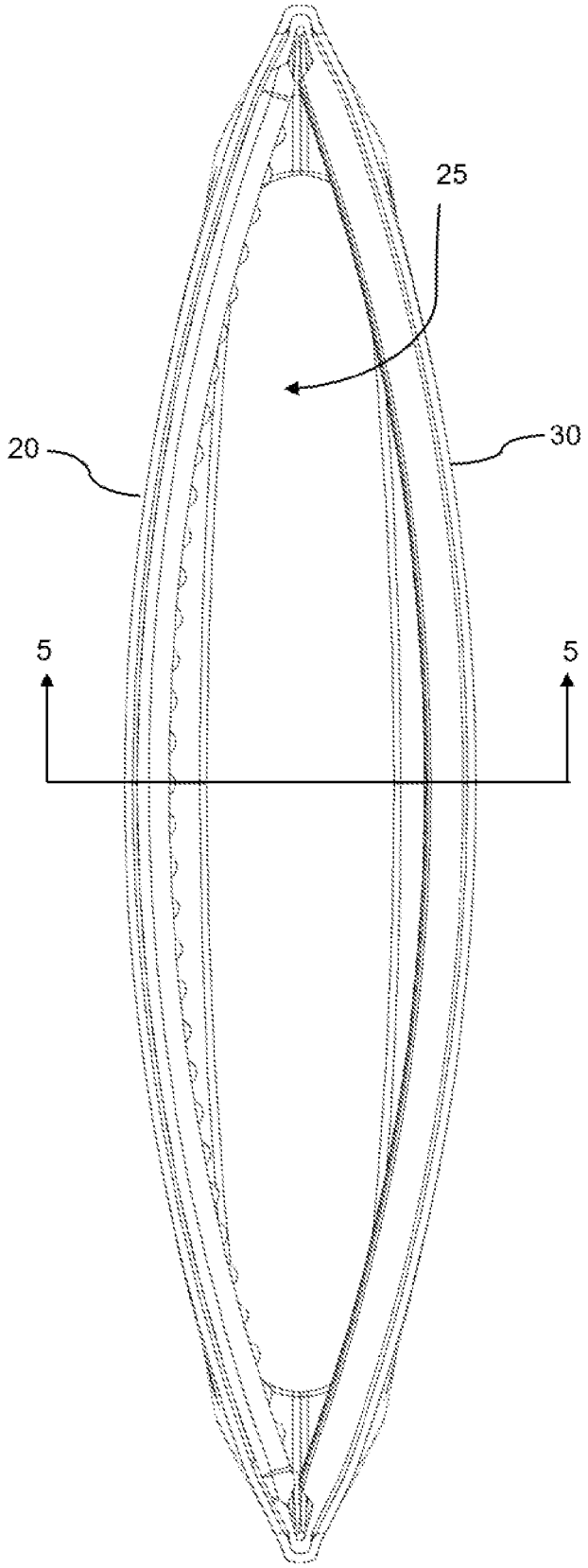
FIG. 2 is a top plan view of a preferred flexible container.

FIG. 2 provides a top plan view of the container as illustrated in FIG. 1, again in which the first panel 20 and second panel 30 are shown spaced apart from one another to provide an interior volume 25.

Figure 3:
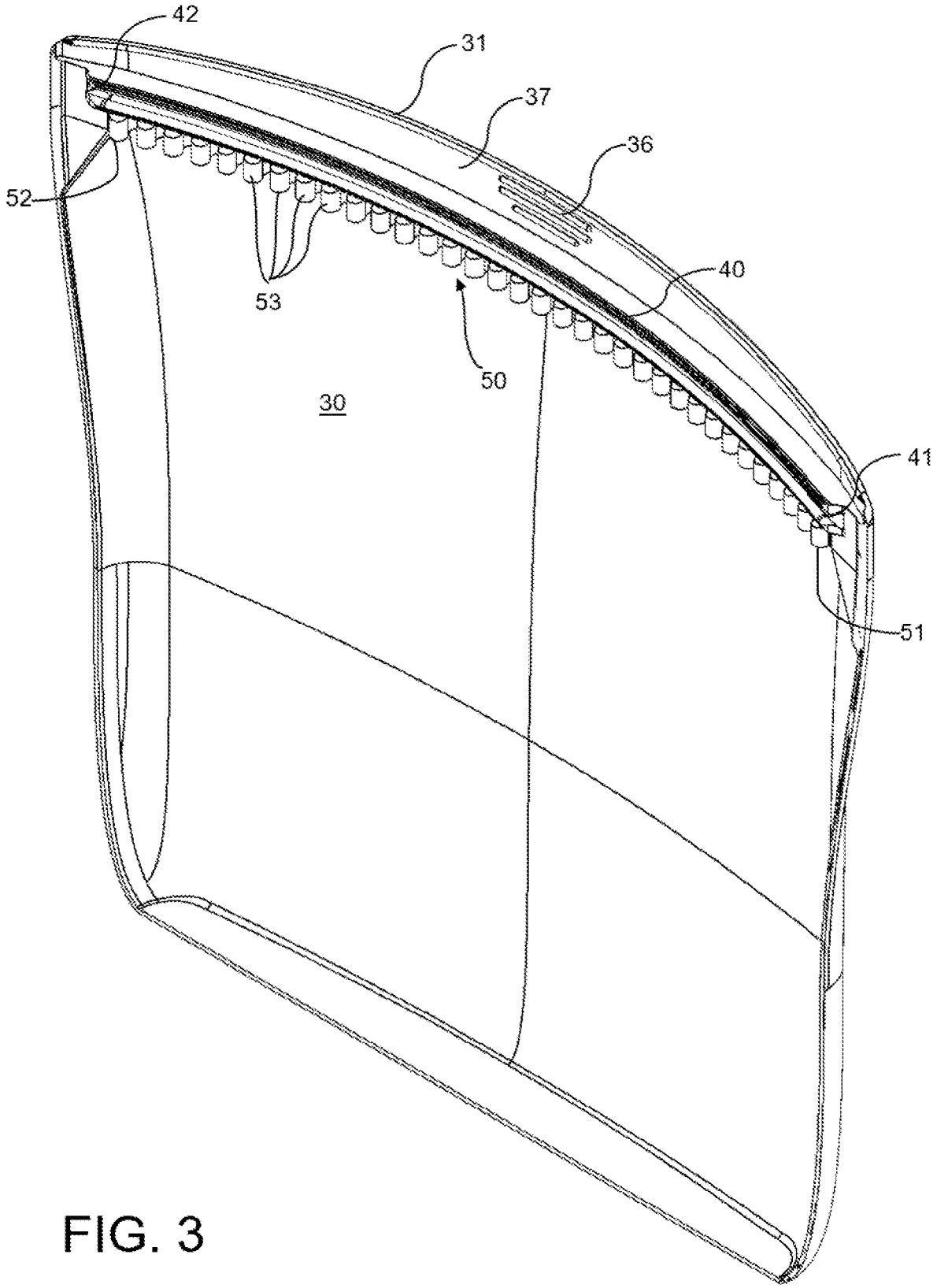
FIG. 3 is a front perspective view of one panel of a preferred flexible container, with an opposing panel removed for clarity of illustration.
Figure 4:
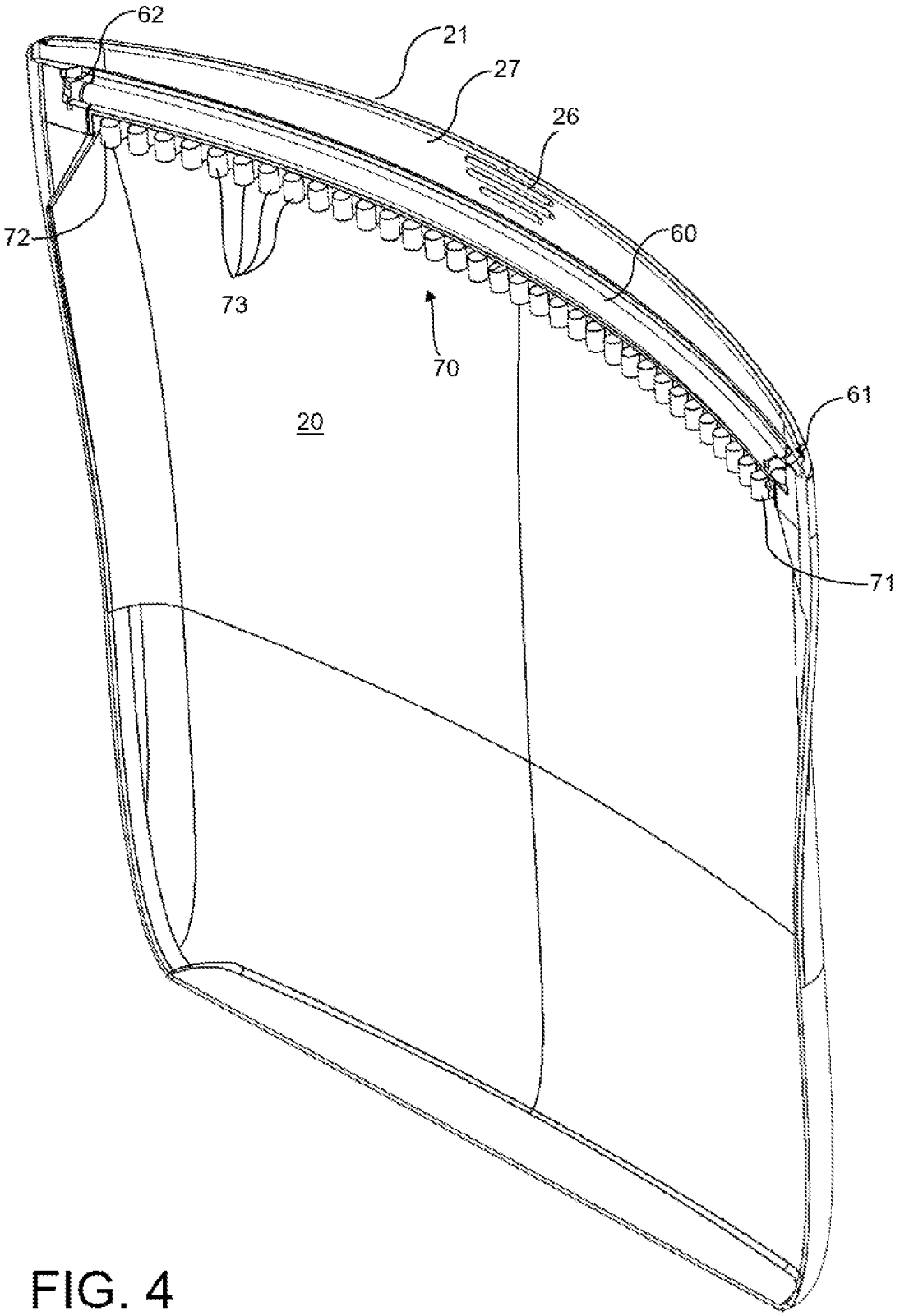
FIG. 4 is a rear perspective view of the opposing panel of a preferred flexible container.

FIG. 3 provides a front perspective view of the second panel, separated from the first panel (that is, with the first panel removed entirely for clarity of illustration), while FIG. 4 provides a rear perspective view of the first panel, separated from the second panel in the same manner. In each case, the separate panel illustrations provide a clearer view of the sealing and closure mechanism which is provided at the top of the container.

In general, the container includes a first closure extending along the top end of the container and a second closure extending along the top end of the container, in which the first and second closures are positioned next to one another, most preferably closely adjacent to one another. Although characterized as the top end of the container, the location of the closures may also be characterized as extending along a portion of a perimeter of the container. Preferably, the first and second closures are structurally different from one another, and in a most preferred version the first closure is configured to provide a strong retention of the first panel to the second panel while the second closure is configured to provide a fluid-tight seal (and in particular, a better seal than the first closure). In the illustrated example, the second closure is positioned relatively closer to the top end of the container than is the first closure.

In one version, the second closure is configured as a rail and groove configuration. A rail 60 includes a first end 61 at one side of the first panel and a second end 62 at the opposite side of the first panel, such that the rail extends continuously from a first side of the first panel to the second side of the first panel, along the top end of the first panel. A groove 40 similarly includes a first end 41 at a first side of the second panel and a second end 42 at the opposite second side of the second panel, such that the groove extends continuously from one side of the second panel to the second side of the second panel, along the top end of the second panel. The rail and groove are sized and dimensioned such that the rail is frictionally held within the groove when the rail is inserted into the groove. In one example, the rail may be slightly larger than the interior dimension of the groove to provide an interference fit. The rail and groove configuration of the second closure is thus configured to provide a fluid-tight seal, but in most instances the rail and groove configuration may not be particularly resistant to strong opening or separation forces.

In the illustrated version, the first closure is configured as an interlocking or zipper closure in which a first plurality of teeth 70 is provided on the second panel and configured to mate with a second plurality of complementary teeth 50 provided on the first panel. In FIG. 3, exemplary teeth 53 from among the second plurality of teeth 50 are indicated, while in FIG. 4 exemplary teeth 73 from among the first plurality of teeth 70 are indicated. The second plurality of teeth extends from a first tooth 51 at the first end of the second panel to a final tooth 52 at the second end of the second panel. Similarly, the first plurality of teeth extends from a first tooth 71 at the first end of the first panel to a final tooth 72 at the second end of the first panel. The interlocking or zipper closure of the first closure is configured to provide strength against an opening force, but would be expected to be less effective at providing a fluid-tight seal than the rail and groove structure of the second closure.

In the illustrated example, the teeth on each panel extend in a direction toward the opposing panel, rather than upwardly toward the opening or downwardly toward the bottom of the container. Most preferably, each tooth extends generally perpendicularly with respect to the panel on which the tooth is formed or attached.

As illustrated and best seen in FIGS. 3 and 4, each of the first panel and second panel includes a short flap 27, 37 extending beyond the first and second closures, at the top end of the panels. Optionally, each flap may include a textured area with ribbing 26, 36 or other forms of texturing to facilitate gripping of the flaps by a user to pry the closures apart. The top end of the container is thus moveable between a first position in which the closures are opened and the top ends of the panels are separated from one another (such as in FIG. 1) and a second position in which the closures are engaged with one another to close and seal the top ends of the panels.

Figure 5:
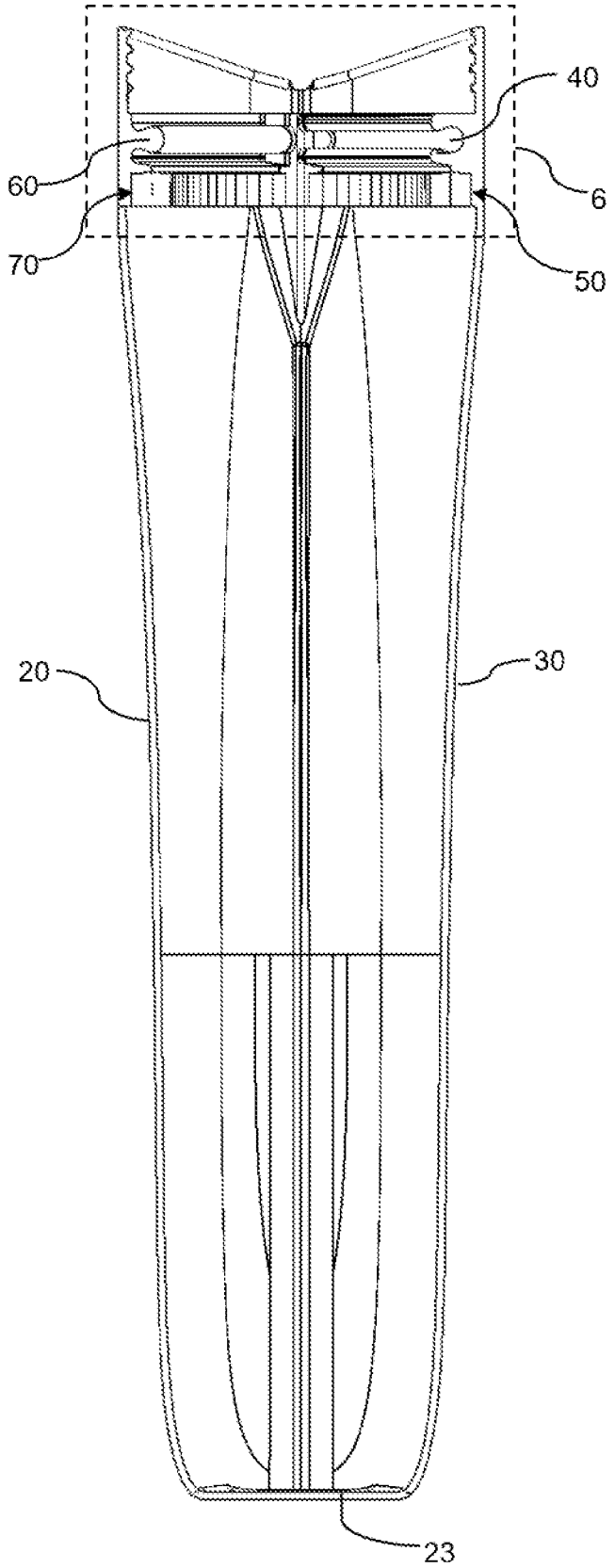
FIG. 5 is a side sectional view of a preferred flexible container, taken along lines 5-5 in FIG. 2.

FIG. 5 is a side sectional view of a preferred container, taken along sectional plane 5-5 in FIG. 2. The first and second panels 20, 30 are shown opposite one another, and extending upward from the bottom of the container 23, which in the example as shown may be configured as a narrow planar floor between the two panels.

Figure 6:
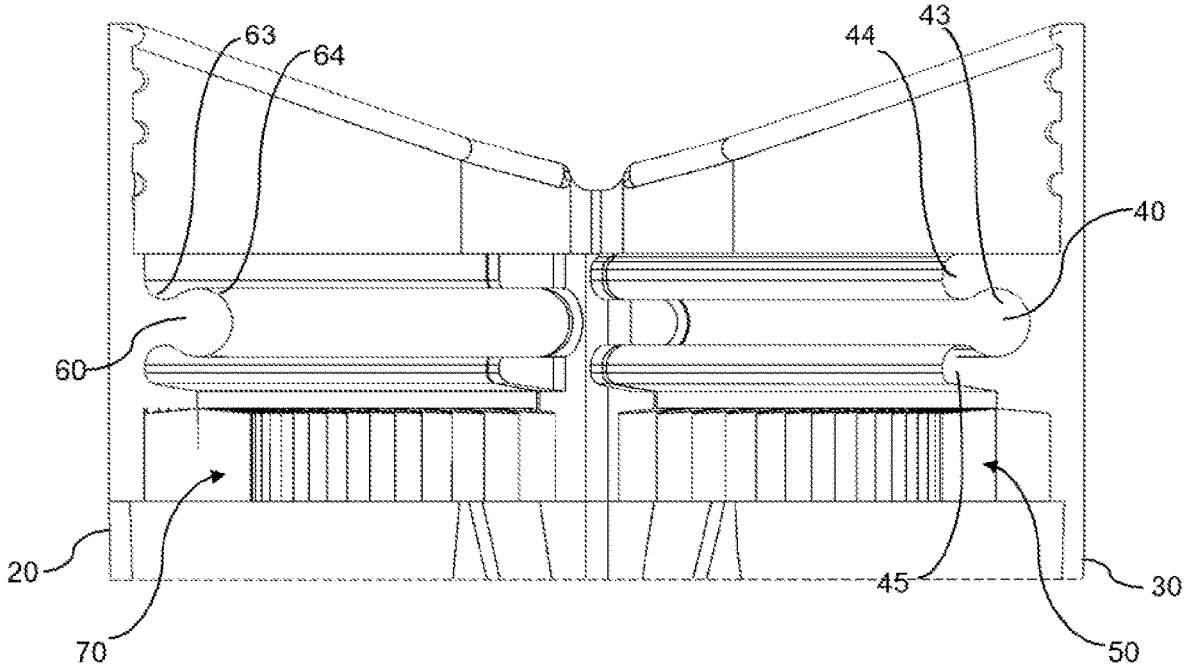
FIG. 6 is a closeup view of detail area 6 indicated in FIG. 5.

Detail area 6 in FIG. 5 is shown in close-up view in FIG. 6. As seen in FIG. 6, the first closure and its rows of opposing teeth 50, 70 is positioned beneath the second closure and its rail 60 and groove 40 structure. In the illustrated example, the rail 60 is configured as an enlarged and rounded head 64 extending from a narrower neck 63, with the neck being attached to the first panel and extending inwardly (toward the interior of the container, and toward the opposing second panel). Similarly, the channel is configured with an enlarged and rounded interior cavity 53 and a narrowed opening defined between opposing upper rims 44, 45. The cavity and opening of the channel is configured to snugly receive the rail in order to provide the fluid-tight fit as discussed above.

Figure 8:
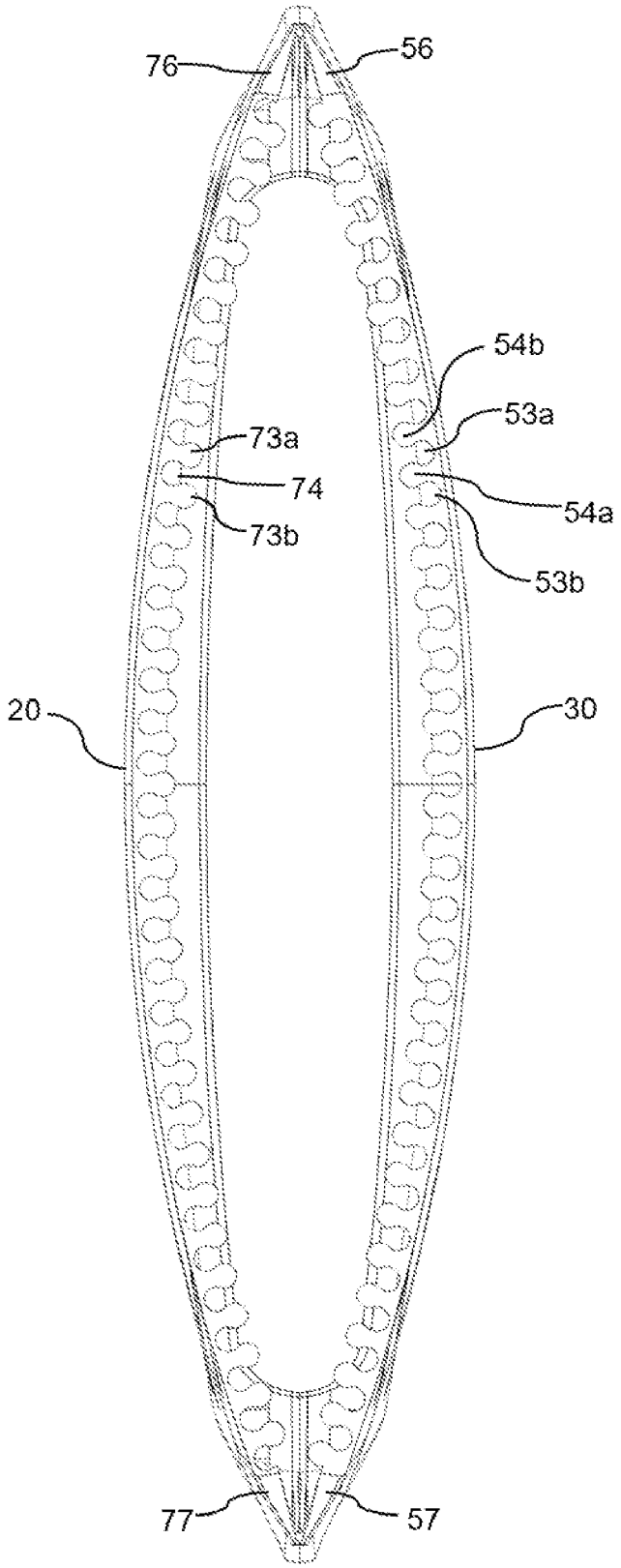
FIG. 8 is a top plan view of the preferred flexible container of FIG. 7.
Figure 9:
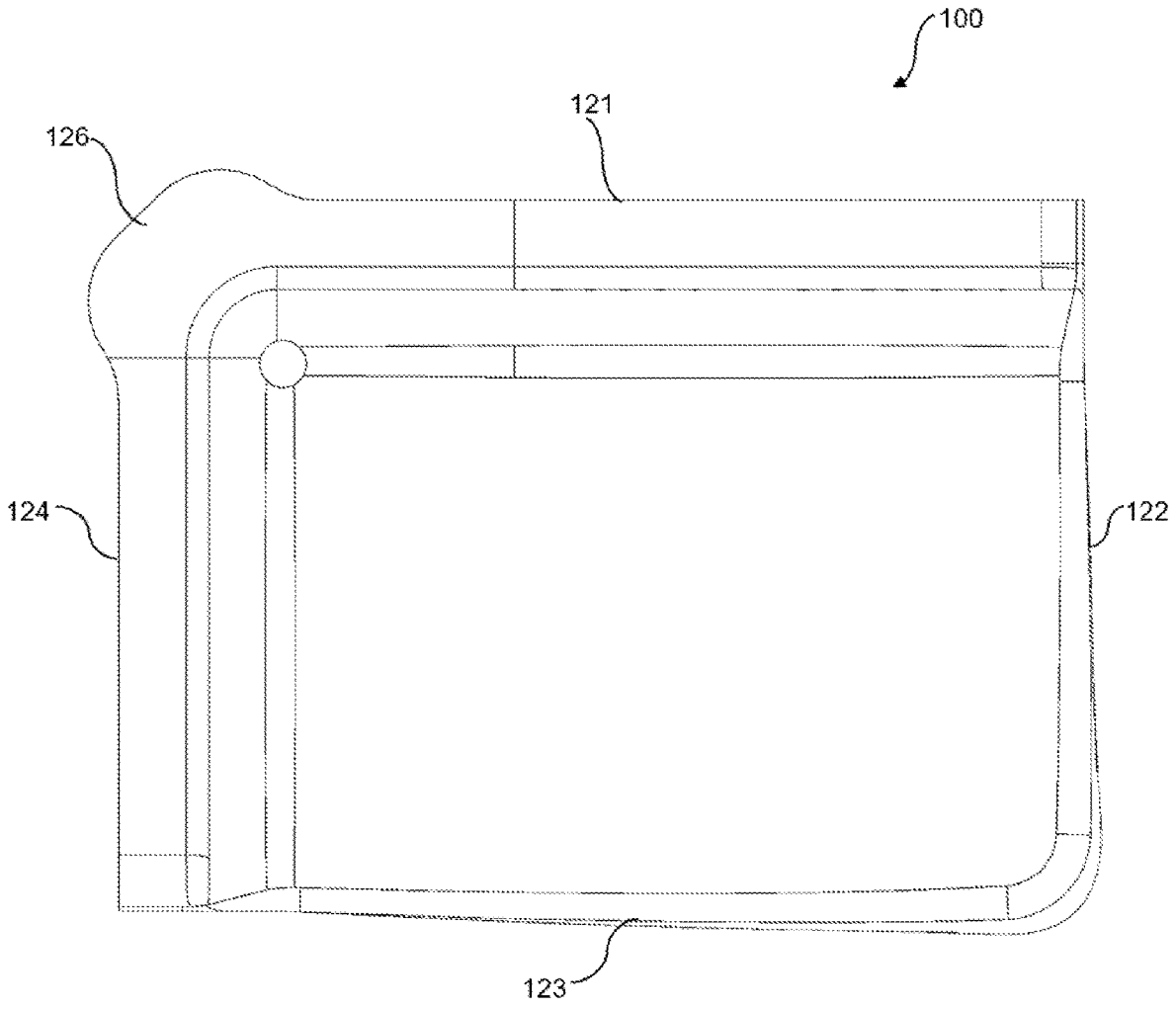
FIG. 9 is an elevational view of an alternate preferred flexible container.

FIG. 7 illustrates a front elevational view of a preferred container, with section plane 8-8 indicated. FIG. 8 is a top plan view of the preferred container of FIG. 7, taken along the sectional plane 8-8 in order to better illustrate the second closure and the opposing teeth. As shown, some exemplary teeth 73*a*, 73*b* from the second plurality of teeth and exemplary teeth 54*a*, 54*b* from the first plurality of teeth are indicated. Each pair of teeth (e.g., 73*a*, 73*b*) includes a complementary-shaped depression (e.g., 74, 53*a*, 53*b*) separating a tooth from its neighbor, sized and shaped to receive a corresponding tooth from among the opposing plurality of teeth in the opposing panel. Thus, for example, when the top ends of the panels are joined together and the closures are fully engaged, tooth 54*a* will be received within depression 74 and tooth 73*a* will be received within depression 53*a*. The interaction of the large plurality of teeth within the corresponding depressions provides a strong force to retain the top end of the container in the closed position. As illustrated, each of the teeth and depressions are configured generally in a fashion similar to that of the rail and channel, such that each tooth has a rounded head and narrowed neck, and each depression has a narrowed opening and a wider cavity.

In one version, the teeth are sized such that there may be insufficient room for teeth at the extreme side ends of the panels. Thus, in the illustrated example, as seen in FIG. 8, each end of the bag or container may terminate in a flattened pair of mating surfaces 56, 76 and 57, 77. These mating surfaces are configured to abut one another when the bag is in the closed position, as an aid to providing a fluid-tight seal when the container is in the closed position.

In use, a food item is placed into the interior space 25 of a container 10 when the container opening is in the first or open position, such as illustrated in FIG. 1. Once the food item is within the container, the top ends of the panels are brought together to seal the container. For example, starting at one end 22 of the container, the top ends are pressed against one another to engage the first closure teeth and depressions closest to that first end, and to engage the portion of the rail and channel at that same end. Pressure is applied along the length of the top of the container, from the first end 22 to the second end 24 to thereby cause the first and second closures to fully engage one another along the entire distance from the first end to the second end. At that point, the top of the container is in the second position, and both the first and second closures are engage to provide a strong and fluid tight seal.

Figure 10:
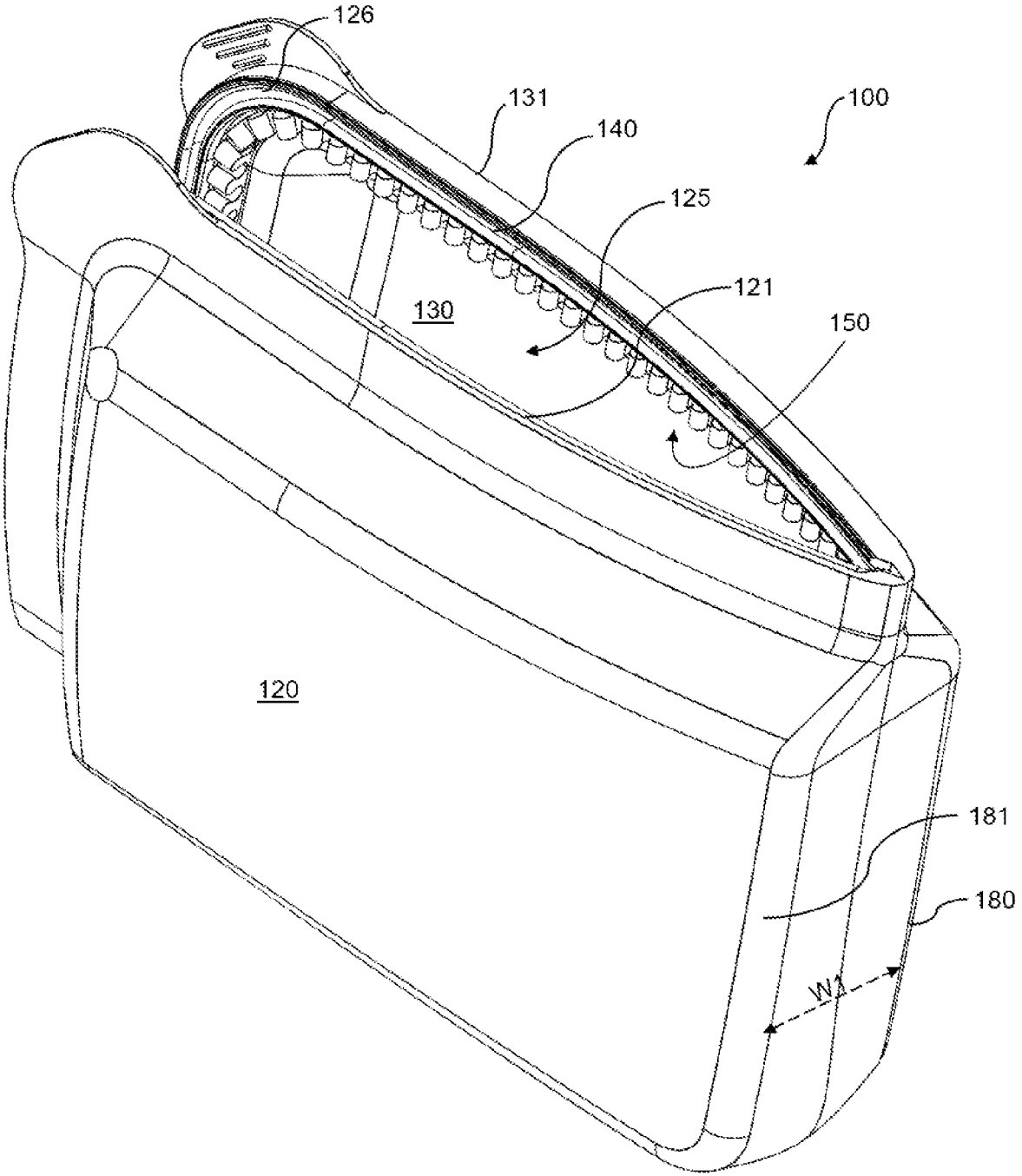
FIG. 10 is a perspective view of the flexible container of FIG. 9, shown in an open position.
Figure 11:
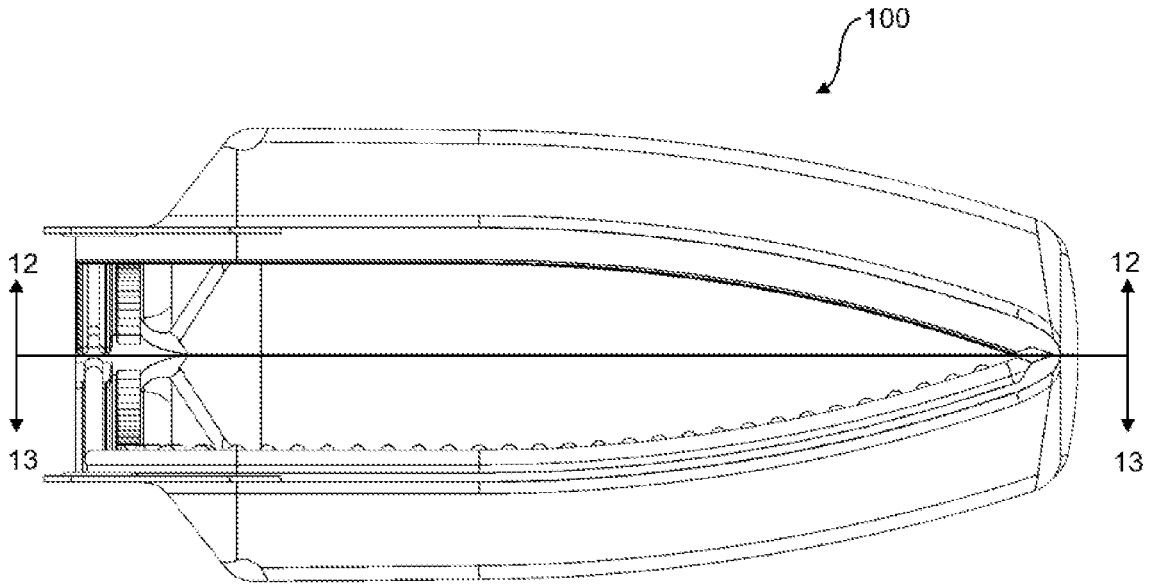
FIG. 11 is a top plan view of the flexible container of FIG. 9.
Figure 12:
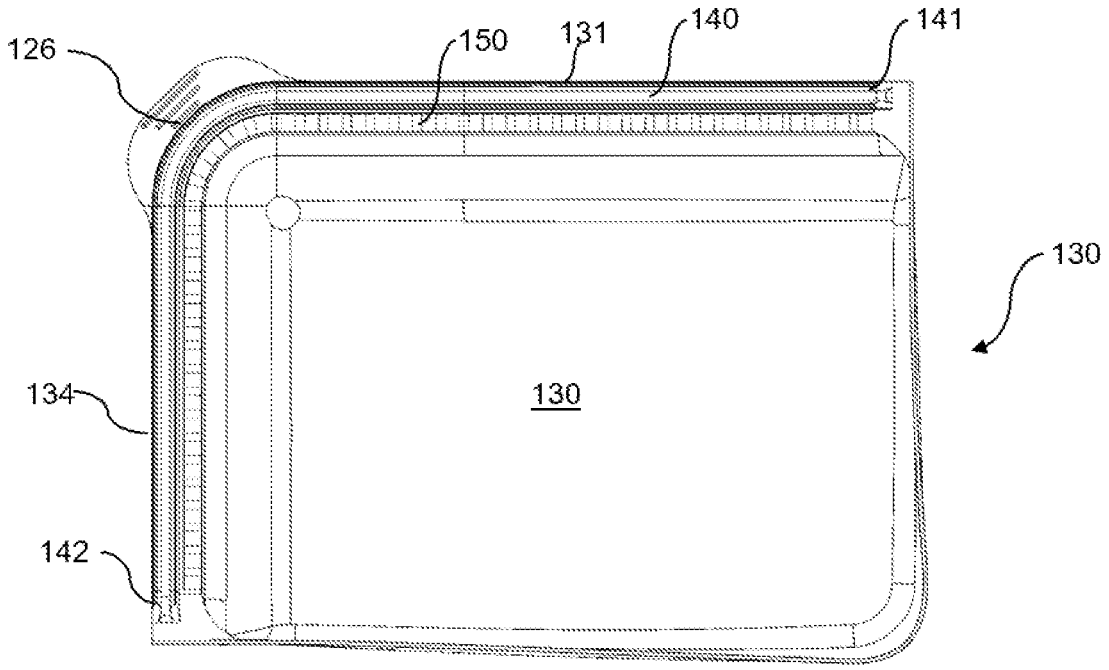
FIG. 12 is a sectional elevational view of the flexible container of FIG. 9, taken along section 12-12 indicated in FIG. 11.
Figure 13:
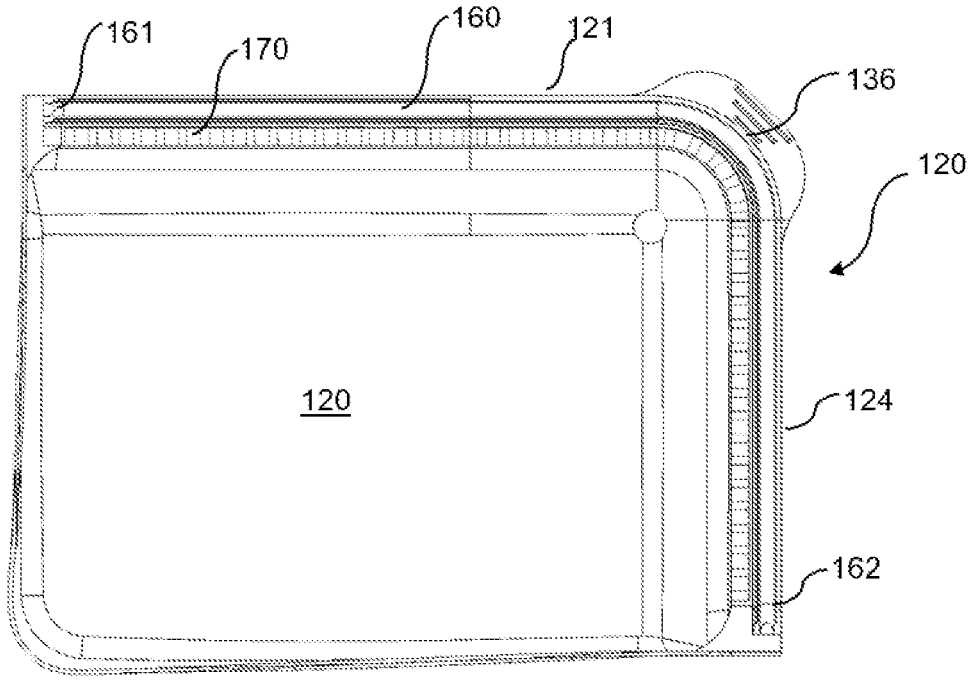
FIG. 13 is a sectional elevational view of the flexible container of FIG. 9, taken along section 13-13 indicated in FIG. 11.

FIGS. 9-13 illustrate another example of a flexible bag 100. In the illustrated example, the container is configured as a bag 100 having a first panel 120 and a second panel 130. The opposing first and second panels are joined along a first side 122, a bottom 123, and a second side 124. Each panel includes a top end 121, 131 which combine to form a top end of the container, and further providing access to the interior space or volume 125 defined in the space between the first and second panels. In FIG. 10, the top ends 121, 131 are shown spaced apart from one another, thereby defining an opening for access to the interior space. FIG. 11 is a top plan view of the second embodiment as described above, indicating sectional plane looking toward one panel in a first direction (12-12) and looking toward the other panel in the opposite direction (13-13). Corresponding FIGS. 12 and 13 show elevational sectional views in the directions as noted above.

In this second example, the flexible bag is permanently sealed along a bottom end 123 and one side 122, but may be selectively opened or sealed along one side 124 and at the top 121. In other versions both sides may be selectively opened or sealed, and in yet another version the bottom may be selectively opened or sealed, in whole or in part. In one example as illustrated, the sealing closure extends along the top end 121, around a corner 126 between a top end and one side 124, and then along the one side 124. Likewise, the sealing closure may extend along a portion of the perimeter of the container in which the portion of the perimeter represents about one quarter of the container perimeter (for example, in the version in which it extends along only a top of the container), or about one half of the container perimeter, or about as much as three quarters of the perimeter.

Most preferably, the seal is configured as with the first embodiment described above, and thus the second closure is configured as a rail and groove configuration. A rail 160 includes a first end 161 at one side of the first panel and a second end 162 at the bottom of one side panel 124, such that the rail extends continuously from a first side of the top of the first panel 120, to the second side of the top of the first panel, around the corner 126, and down a side 124 of the panel to the bottom of the side 124. A groove 140 similarly includes a first end 141 at a first side of the top of the second panel and a second end 142 at the bottom of the second side of the second panel, such that the groove extends continuously along the top and down one side of the second panel. The rail and groove are sized and dimensioned such that the rail is frictionally held within the groove when the rail is inserted into the groove. In one example, the rail may be slightly larger than the interior dimension of the groove to provide an interference fit. The rail and groove configuration of the second closure is thus configured to provide a fluid-tight seal, but in most instances the rail and groove configuration may not be particularly resistant to strong opening or separation forces.

In some versions, the ends of the rail and groove may extend partially, but not fully, to the bottom or across the top of the panel. In one version, the rail and groove extend across at least seventy five percent, or at least two thirds, along the top and at least seventy five percent, or at least two thirds, down toward the bottom. In other versions, the rail and groove extend at least halfway from the top toward the bottom. As used in this description, a closure that extends substantially to the bottom of one side is one which extends at least eighty percent of the way from the top to the bottom.

In the illustrated version, the first closure is configured as an interlocking or zipper closure in which a second plurality of teeth 150 is provided on the second panel and configured to mate with a first plurality of complementary teeth 170 provided on the first panel. The interlocking teeth are configured in the manner as described above for the first embodiment, and travel along a path of substantially the same distance as that of the rail and groove as described above.

As illustrated, each of the first panel and second panel may include a short flap extending beyond the first and second closures, at the corner of the panels where the top and one side meet. Optionally, each flap may include a textured area with ribbing or other forms of texturing to facilitate gripping of the flaps by a user to pry the closures apart, as described above and as illustrated. The top end of the container, and one side, is thus moveable between a first position in which the closures are opened and the top ends of the panels are separated from one another (such as in FIG. 10) and a second position in which the closures are engaged with one another to close and seal the top ends of the panels.

Figure 14:
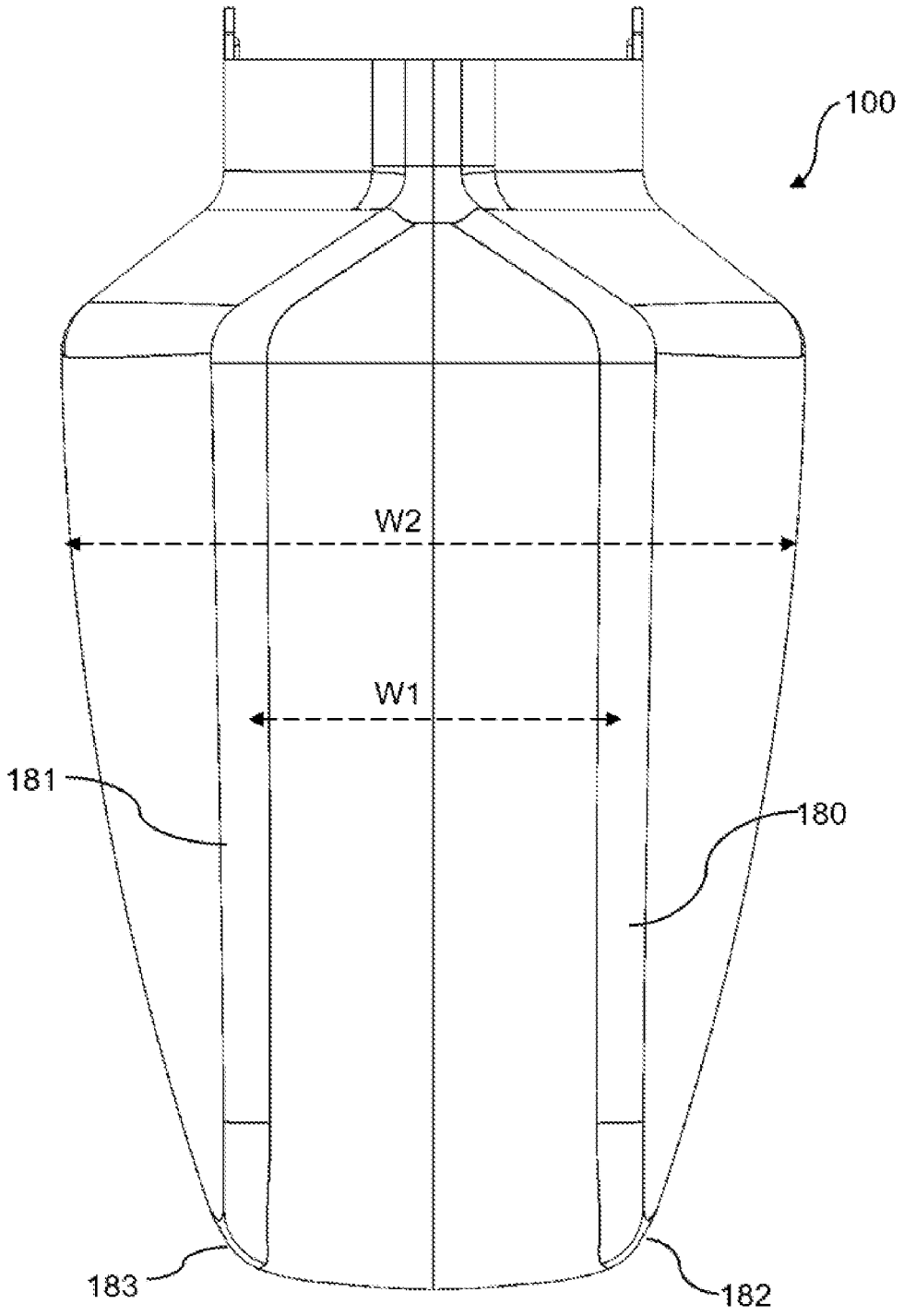
FIG. 14 is a right-side elevational view of a preferred flexible container of FIG. 9.

FIG. 14 is a right-side elevational view of the second embodiment 100, illustrating preferred geometry for an example container. In the illustrated example, the container includes predefined corners 180, 181 along each side and predefined corners 182, 183 extending along the bottom. The predefined corners define side and end walls having a first width W1 which is either planar or slightly bowed. The sidewalls may further be sized to provide a bowed width W2 which is greater than the first width, to provide an enlarged capacity. In one example, the first width W1 is configured to accommodate an average sandwich thickness and thus is in the range of one inch to two inches.

Figure 15:
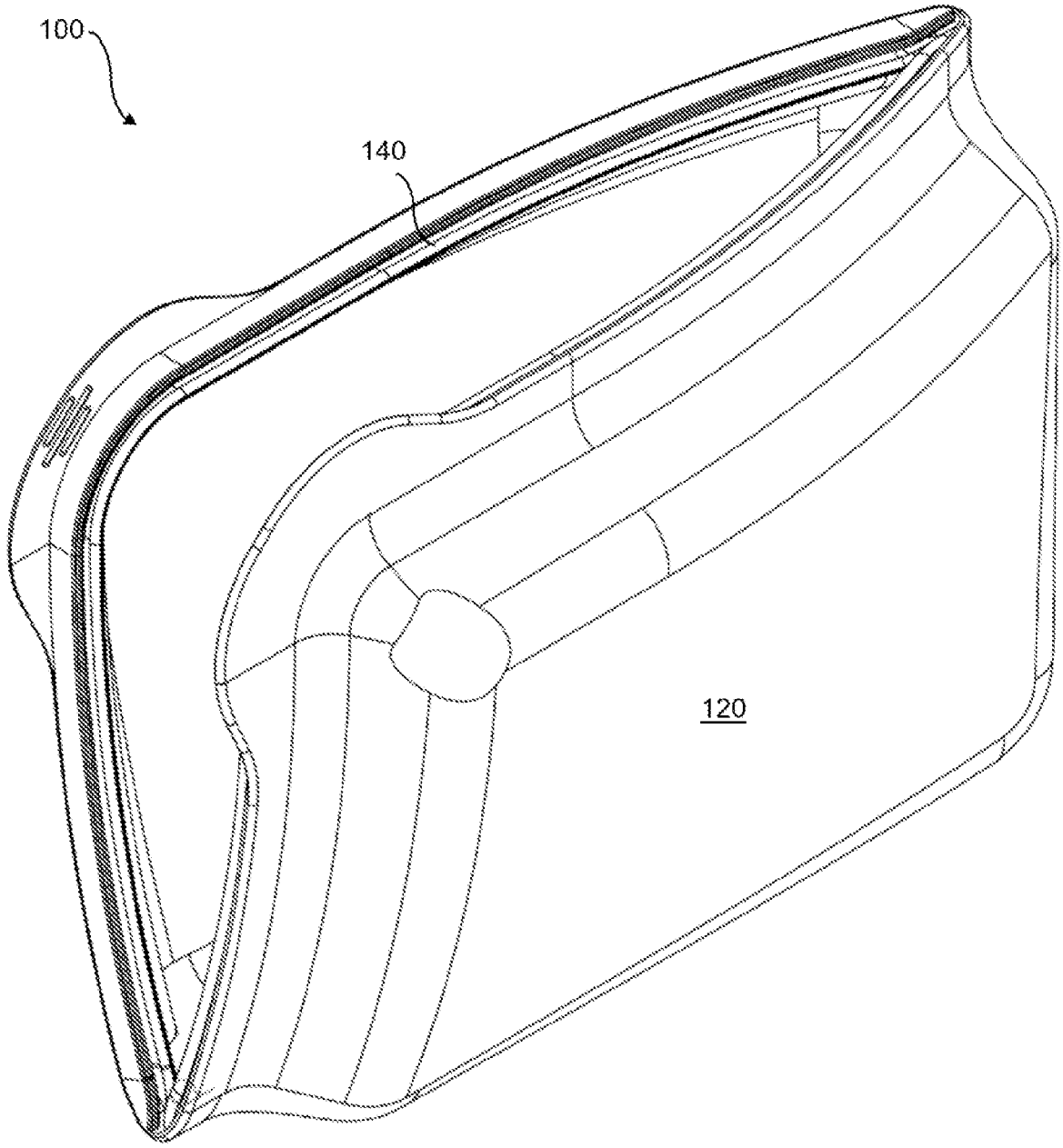
FIG. 15 is a perspective view of a preferred flexible container.

In the version as illustrated in FIGS. 10-14, the rail and track of interlocking teeth extend along the entire region of the opening, at both the top and the side (or multiple sides, as may apply). In other versions, the closure includes a rail but no track of interlocking teeth, such as shown in FIG. 15 illustrating a rail 140 but no teeth.

Figure 16:
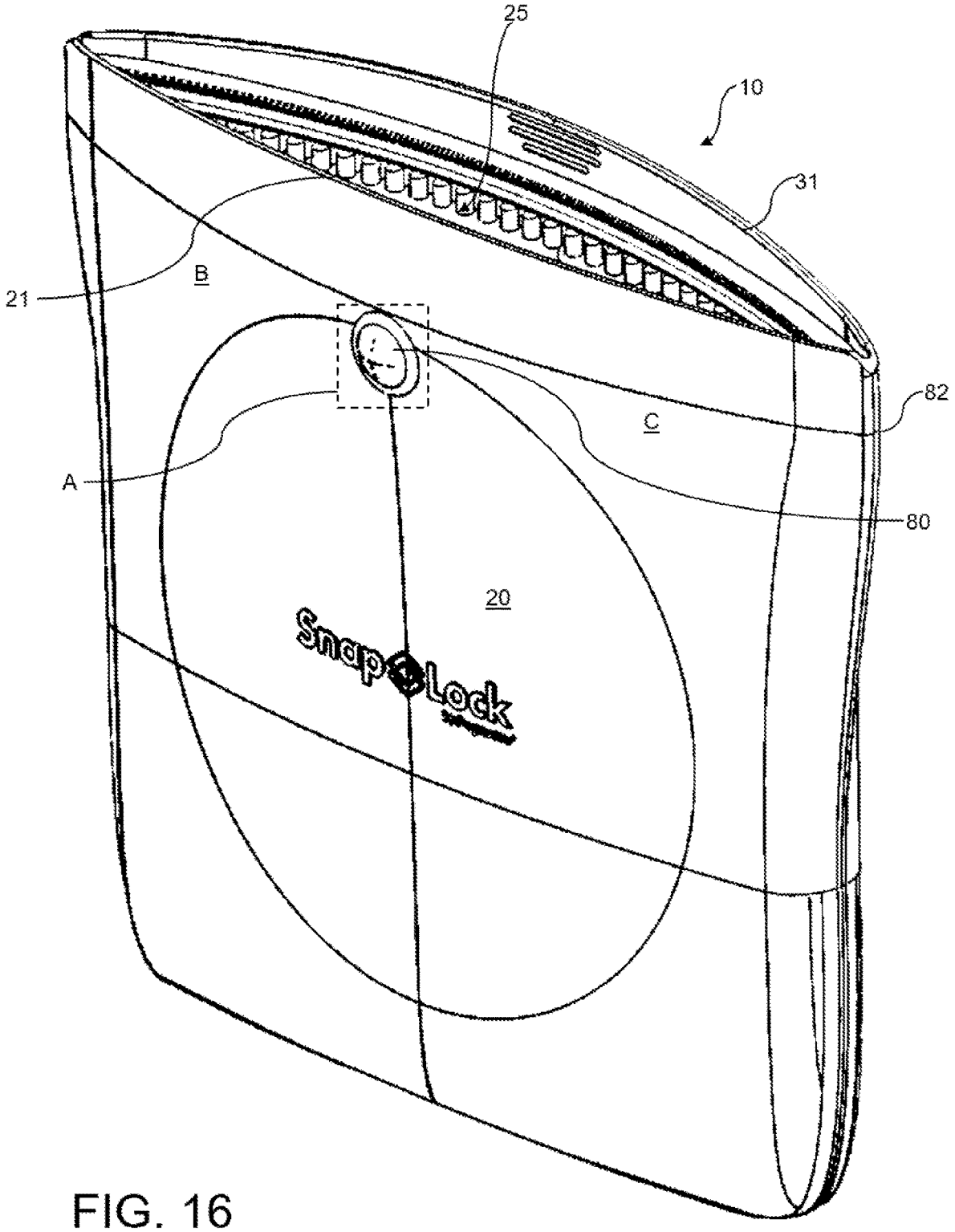
FIG. 16 is a perspective view of a preferred flexible container incorporating a vent.
Figure 17:
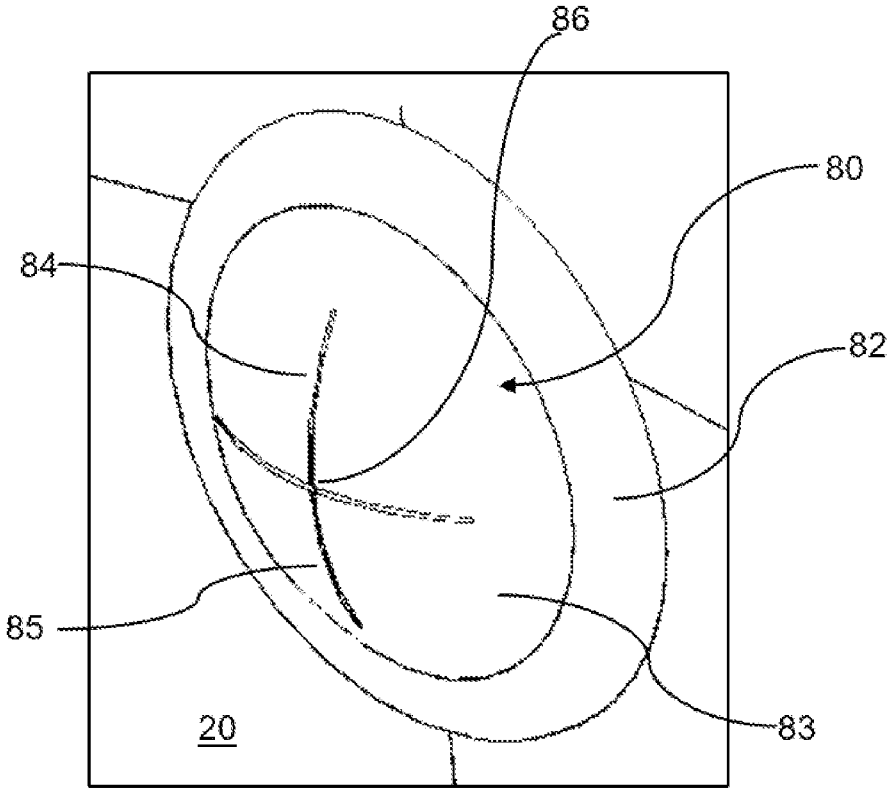
FIG. 17 is a closeup view of vent detail A from FIG. 16.

In some versions, the flexible container may be vented, such as shown in FIGS. 16 and 17. Preferably in such a version the container is the same as described above, but it includes one or more vents located on the container to allow air or steam to exit from the container when under pressure. As shown in FIG. 16, a vent 80 is provided on the first panel 20 of the container, near the top end 21 but just beneath the closure as described above, and which is positioned generally at the illustrated tangent line 82. A close-up view of the area indicated as detail A showing preferred form of vent is shown in FIG. 17. The vent is thus preferably located on an interior surface of the panel to allow venting from an interior space defined by the enclosed flexible container.

In some versions, a plurality of vents is provided in the flexible container, such as locations B and C indicated on the first panel 20, either in addition to or instead of the first vent 80. Most preferably the vent or vents are provided only on one of either the first panel or the second panel, but in other versions of the invention one or more vents are provided on both of the first panel and the second panel. Likewise, in some versions of the invention the vents may be provided at a location other than the indicated location along the closure line 82 as shown.

With reference to the close-up view of detail A in FIG. 17, the preferred vent 80 is formed with a thickened annular perimeter 82 and a domed interior 83 which extends outwardly away from the interior of the container. One or more slits 84, 85 are provided within the domed section, in which the slits extend through the first panel 20 of the container to allow air to travel from inside the container to the outside of the container. The domed shape should impede or prevent gasses from entering the container from the outside, but allow gasses to escape from the inside of the container when under pressure. Ideally, as shown, a pair of slits is provided, orthogonal to one another and intersecting at a central intersection point 88.

The ventilated version of the flexible container is especially suitable for using the container for heating or cooking food items which might generate steam, or which other wise might cause air within the container to expand when heated and thereby produce an urging force against the seal. The vent, or vents, allow air or steam to escape, reducing the amount of pressure which would otherwise act against the seal and might cause the seal to break open under force. Placement of the vents along the seal line may further provide the greatest force-reducing benefit in that same region, thereby further aiding in reducing the prying force. In one version, the flexible container is a silicone bag as described above, with one or more vents along the seal line. Such a container is useful for cooking or heating a variety of foods, such as popcorn, and provides a reusable container for this purpose.

In use, a user places a food item such as vegetables or a volume of popcorn kernels inside the bag which includes a vent, then seals the bag by pressing the closures together as described above. The container may then be heated such as in a microwave oven, with the vent allowing generated steam to escape. The food items may be removed and consumed, and the container may be cleaned and used again in the same manner.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims.

We claim:

1. A flexible container, comprising:

a first panel formed from a flexible elastomeric material and having a first panel top, a first panel bottom, and a pair of opposing first panel sides extending between the first panel top and the first panel bottom, the first panel having a first panel interior surface and a first panel exterior surface, the first panel top further terminating with a flap;

a second panel formed from the flexible elastomeric material and having a second panel top, a second panel bottom, and a pair of opposing second panel sides extending between the second panel top and the second panel bottom, the second panel having a second panel interior surface and a second panel exterior surface;

the second panel being joined to the first panel to form the flexible container and defining an interior volume between the first panel and the second panel, the flexible container having a flexible container top, a flexible container bottom, and a pair of opposing flexible container sides extending between the flexible container top and the flexible container bottom, the first panel interior surface being positioned opposite from and facing toward the second panel interior surface;

a first closure positioned adjacent the flexible container top, the first closure having a first plurality of teeth separated from one another and extending in a row from the first panel side to the opposing first panel side along the first panel top on the first panel interior surface and a second plurality of teeth separated from one another and extending in a row from the second panel side to the opposing second panel side along the second panel top on the second panel interior surface, the first plurality of teeth being removably interlockable with the second plurality of teeth;

each of the first plurality of teeth being configured with a first narrow neck and a first rounded head, the first rounded head extending outward from the first narrow neck in a direction perpendicularly away from the first panel interior surface such that the first rounded head is separated from the first panel by the first narrow neck;

each of the second plurality of teeth being configured with a second narrow neck and a second rounded head extending outward from the second narrow neck in a direction perpendicularly away from the second panel interior surface such that the second rounded head is separated from the second panel by the second narrow neck; and a second closure positioned adjacent the flexible container top and adjacent the first closure, the second closure having a rail extending along the first panel top on the first panel interior surface and a groove extending along the second panel top on the second panel interior surface, the rail being sized and configured to removably seat within the groove to provide a fluid-tight seal along the second closure, the rail further having a narrow rail neck and a rounded rail head extending outward from the rail neck in a direction perpendicularly away from the first panel such that the rounded rail head is separated from the first panel by the narrow rail neck;

the second closure being positioned between the first closure and the flexible container top, wherein the first closure is positioned inside an interior space bounded by the second closure, the flexible container bottom, and the pair of opposing flexible container sides when the rail is seated within the groove;

whereby the flexible container top may be selectively closed by interlocking the first plurality of teeth with the second plurality of teeth and seating the rail within the groove.

2. The flexible container of claim 1, wherein the narrow rail neck and the rounded rail head combine to form a teardrop shape.

3. The flexible container of claim 2, further comprising a flap positioned at the flexible container top, the first closure and the second closure being positioned between the flap and the flexible container bottom.

4. The flexible container of claim 1, wherein the flexible elastomeric material comprises a food grade silicone material.

5. The flexible container of claim 1, wherein the first closure and the second closure each further extend from the flexible container top toward the flexible container bottom along at least one of the opposing flexible container sides.

6. The flexible container of claim 1, wherein the first closure and the second closure extend along a first one of the opposing flexible sides to the flexible container bottom, and the first panel is permanently joined to the second panel along an opposing second one of the opposing flexible container sides and along the flexible container bottom.

7. The flexible container of claim 1, further comprising a vent formed in the first panel, the vent being positioned between the first and the second closures and the flexible container bottom.

8. A flexible container, comprising:

a first panel formed from a flexible elastomeric material;

a second panel formed from the flexible elastomeric material;

the second panel being joined to the first panel to form the flexible container and defining an interior volume between the first panel and the second panel;

the flexible container having a perimeter and an opening provided along a portion of the perimeter;

a first closure positioned adjacent the opening at the portion of the perimeter, the first closure having a first plurality of teeth separated from one another and positioned in a row from a first panel side to an opposing first panel side on the first panel and a second plurality of teeth separated from one another and positioned in a row from a second panel side to an opposing second panel side on the second panel, the first plurality of teeth being removably interlockable with the second plurality of teeth;

each of the first plurality of teeth having a first neck and a first head, the first head extending outward from the first neck in a direction perpendicularly away from the first panel such that the first head is separated from the first panel by the first neck;

each of the second plurality of teeth having a second neck and a second head extending outward from the second neck in a direction perpendicularly away from the second panel such that the second head is separated from the second panel by the second neck; and a second closure positioned adjacent the opening at the portion of the perimeter, the second closure having a rail positioned on the first panel, the rail having a rail neck and a rail head extending perpendicularly away from the first panel such that the rail head is separated from the first panel by the rail neck;

the second closure further having a groove positioned on the second panel, the rail being sized and configured to removably seat within the groove to provide a fluid-tight seal along the second closure;

the first closure being positioned between the second closure and the interior volume;

whereby the flexible container may be selectively sealed by interlocking the first plurality of teeth with the second plurality of teeth and seating the rail within the groove.

9. The flexible container of claim 8, wherein the portion of the perimeter extends along one half of the perimeter of the flexible container.

10. The flexible container of claim 8, wherein each of the first plurality of teeth and each of the second plurality of teeth is configured with a rounded head and a narrow neck.

11. The flexible container of claim 8, wherein the flexible elastomeric material comprises a food grade silicone material.

12. The flexible container of claim 8, further comprising a flap positioned at the portion of the perimeter, the first closure and the second closure being positioned between the flap and the interior volume.

13. The flexible container of claim 8, further comprising a vent formed in the first panel, the vent being configured to allow a gas to escape from the interior volume when the flexible container is sealed at the first closure and the second closure.

14. The flexible container of claim 13, wherein the vent comprises a plurality of vents.

15. The flexible container of claim 13, wherein the vent is located on an interior surface of the flexible container.

* * * * *